US005836151A

United States Patent [19]

Atanasyan et al.

[11] Patent Number: 5,836,151

[45] Date of Patent: Nov. 17, 1998

[54] METHOD AND DEVICE FOR REDUCING HARMFUL GAS EMISSIONS FROM A MOTOR VEHICLE INTERNAL COMBUSTION ENGINE

[75] Inventors: Alain Antranik Atanasyan, Tournefeuille; Alain Michel Aubourg, Toulouse; Alain Joseph Perez, Fonsorbes, all of France

[73] Assignee: Siemens Automotive S.A., Toulouse Cedex, France

[21] Appl. No.: 495,569

[22] PCT Filed: Jan. 17, 1994

[86] PCT No.: PCT/EP94/00105

§ 371 Date: Jul. 27, 1995

§ 102(e) Date: Jul. 27, 1995

[87] PCT Pub. No.: WO94/17296

PCT Pub. Date: Aug. 4, 1994

[30] Foreign Application Priority Data

Jan. 29, 1993 [FR] France ..... 93 00960

[51] Int. Cl.[6] ..... F01N 3/20

[52] U.S. Cl. ..... 60/274; 60/284; 60/286; 123/179.3

[58] Field of Search ..... 60/274, 284, 300, 60/286; 123/179.3

[56] References Cited

U.S. PATENT DOCUMENTS

| | | | |
|---|---|---|---|
| 3,895,541 | 7/1975 | Nohira et al. . | |
| 4,226,090 | 10/1980 | Horian | 123/198 R |
| 4,721,083 | 1/1988 | Hosaka | 123/179.3 |
| 5,131,293 | 7/1992 | Kaiser et al. . | |
| 5,265,418 | 11/1993 | Smith | 60/284 |
| 5,390,493 | 2/1995 | Fujishita | 60/284 |

FOREIGN PATENT DOCUMENTS 2169195 9/1973 France .

*Primary Examiner*—Douglas Hart
*Attorney, Agent, or Firm*—Herbert L. Lerner; Laurence A. Greenberg

[57] ABSTRACT

According to the invention, during a phase in which the engine is cold-started, the mechanical power supplied by the engine (1) to an auxiliary (23) is reduced by comparison with that normally absorbed by the auxiliary in normal operation. When this auxiliary is an alternator, the reduction in the power supplied by the engine, and therefore the slightest pollution which accompanies it, may be obtained by reducing the excitation current (i) of the alternator, under the control of a computer (11).

13 Claims, 2 Drawing Sheets

METHOD AND DEVICE FOR REDUCING HARMFUL GAS EMISSIONS FROM A MOTOR VEHICLE INTERNAL COMBUSTION ENGINE

BACKGROUND OF THE INVENTION

FIELD OF THE INVENTION

The present invention relates to a method and to a device for reducing the emissions of harmful gases produced by an internal combustion engine and, more particularly, to such a method and to such a device which are designed for an engine propelling a motor vehicle and supplying energy to various auxiliaries such as an alternator, an air-conditioning compressor, a pump forming part of a hydraulic suspension device or of a power-assisted steering device, etc.

Such auxiliaries are becoming more numerous in current vehicles, whether in order to improve the comfort of the vehicle or in order to satisfy increasingly strict anti-pollution standards. These auxiliaries are driven by the engine, via belts or chains and thus increase the load on this engine. This increase is particularly damaging during a phase in which the latter is cold-started, at a time when the necessary enrichment in the air/fuel mixture leads to increased pollution by exhaust gases laden particularly with unburnt hydrocarbons, while at the same time the means used to reduce this pollution, such as catalytic converters, are not effective as they have not yet reached a sufficient temperature.

In order to reduce this pollution, it has been proposed to warm up the catalytic converter by electrical heating drawn from the battery of the vehicle and/or to inject air into the exhaust from the engine. However, these measures involve additional consumptions of electrical energy which lead to the battery and the alternator which charges it being made larger, the latter element then consuming increased mechanical energy which the engine has to provide at the cost of a production in exhaust gases which is also increased and which greatly reduces the benefit of these measures.

Document FR-A-2,169,195 also makes known a method for reducing emissions according to which the warming-up of the engine is accelerated by uncoupling the members such as the coolant-circulating pump and/or the fan by means of electromagnetic clutches and by increasing the rotational speed of the engine. However, such a method, although it reduces the engine warming-up time during which the emissions of pollutants are the greatest, increases these emissions owing to the increase in speed.

SUMMARY OF THE INVENTION

The object of the present invention is therefore to supply a method and a device making it possible to reduce effectively the production of harmful gases by an internal combustion engine propelling a motor vehicle.

Another object of the present invention is to supply such a method and such a device making it possible to reduce this production particularly during a phase in which the engine is cold-started, so as to ensure compliance with the strictest anti-pollution standards.

These objects of the invention, as well as others which will emerge upon reading the description which follows, are achieved with a method according to which, during a phase in which the engine of the vehicle is warmed up, the operating conditions of at least one auxiliary are modified so as to reduce the mechanical power absorbed by comparison with that absorbed by the auxiliary in normal operation.

By thus reducing the power absorbed by all the auxiliaries normally loading the engine, such as an alternator, an air-compressor, a pump, etc., and which are not absolutely necessary to the starting thereof, the load on the engine is substantially lightened and this in consequence substantially reduces the production of exhaust gases by this engine and, finally, the pollution of the environment by these gases.

According to one strategy in the implementation of the method according to the invention, the reduction in the mechanical power supplied to the auxiliary is stopped when the temperature of a catalytic converter for treating the exhaust gases from the engine and/or the temperature of the engine itself reaches a predetermined value. These temperature conditions determine the moment at which the engine and/or the catalytic converter have reached an operating condition close to normal, such that it becomes possible to supply the auxiliaries with mechanical energy without exceeding the anti-pollution standards.

According to a particular embodiment of the method according to the invention, applied to a motor vehicle equipped with a battery for supplying electricity which is recharged by an auxiliary consisting of an alternator, the mechanical power absorbed by the alternator is reduced by reducing the strength of its excitation current.

For the implementation of the method according to the invention, the invention supplies a device which comprises means for modifying the operating conditions of at least one auxiliary so as to reduce, during a phase in which the engine of the vehicle is warmed up, the mechanical power absorbed by comparison with that absorbed by the auxiliary in normal operation. In one embodiment of the device according to the invention, designed for a motor vehicle equipped with a battery for supplying electricity which is recharged by an alternator, said means for reducing the mechanical power absorbed by the alternator comprise means for reducing the strength of its excitation current.

BRIEF DESCRIPTION OF THE DRAWINGS

Other features and advantages of the present invention will emerge upon reading the description which follows and upon examining the appended drawing in which.

DESCRIPTION OF THE PREFERRED EMBODIMENT

Figure 1:
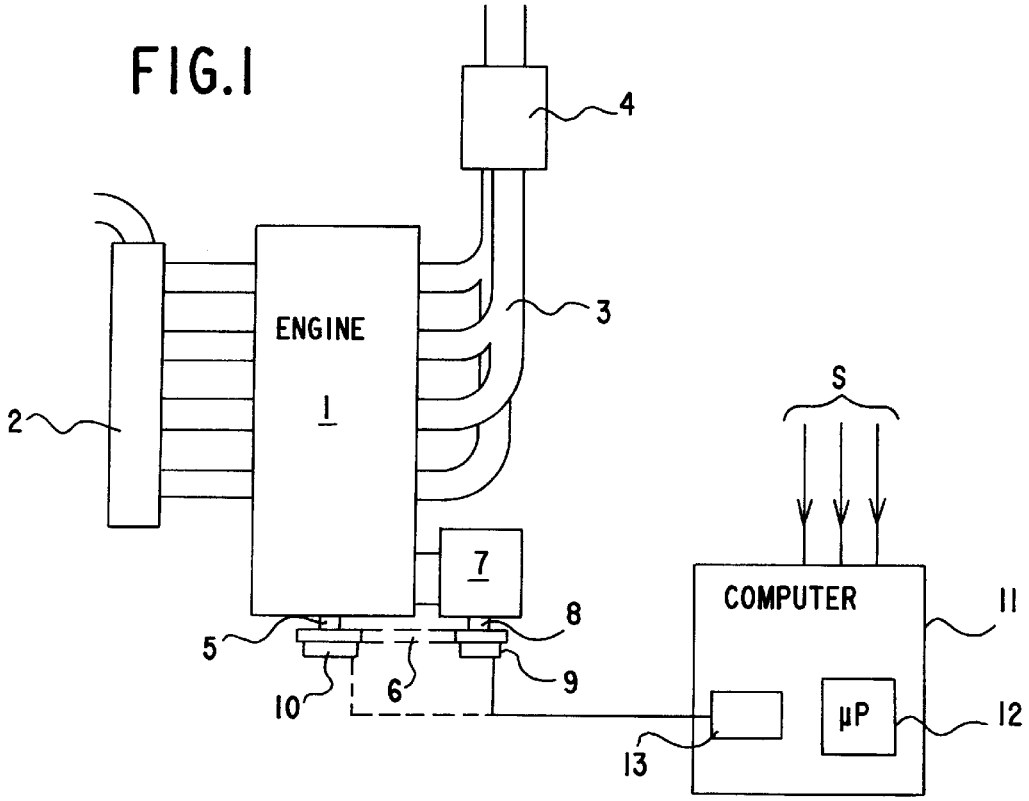
FIG. 1 is a diagram of an internal combustion engine equipped with an auxiliary and with control means.

In these figures, in which identical numerical references identify members or elements which are identical or similar, FIG. 1 shows diagrammatically an internal combustion engine 1 propelling a motor vehicle, this engine being supplied with air via an inlet mani-fold 2, the combustion gases being discharged into an exhaust manifold 3, the outlet of which may be equipped with a catalytic converter 4 for oxidation-reduction of certain chemical species contained in these gases into less harmful chemical species.

The output shaft 5 of the engine, conventionally connected to the gearbox of the motor vehicle via a clutch (not represented) is also conventionally connected by a belt or a chain 6 to an auxiliary 7 which thus receives mechanical energy from the engine 1, via its input shaft 8. For the clarity of the drawing, just one auxiliary 7 has been represented, but it should be understood that the engine normally drives several such auxiliaries—alternator for charging the battery (not represented) of the vehicle, fan and, optionally, refrigerant gas compressor forming part of a device for air-conditioning the vehicle, pump for pressurizing a fluid used in a suspension device or power-assisted steering device of this vehicle, etc., as was seen earlier.

It is clear that increasing the number of such auxiliaries, although enhancing the comfort of the vehicle, simultaneously increases the load to which the engine is subjected as soon as it starts up, these auxiliaries conventionally being permanently mechanically coupled to the engine. This results, during a phase in which the engine is being started up, in the need to make the latter operate at a speed which is high enough for it to be able to deliver the torque necessary to overcome simultaneously the internal friction opposing its rotation and the external friction opposing the driving of the auxiliaries. The high torque which it develops then leads to a heavy production of exhaust gases that the catalytic converter 4 cannot purge of its harmful species owing to the fact that this converter has not yet reached its working temperature, which normally lies around 700° C. The exhaust gases therefore pollute the environment in a way deemed unacceptable by some anti-pollution standards. It is the objective of the present invention to contrive for the emissions from the engine 1 to comply with these standards.

The vehicle is conventionally equipped with an electronic computer 11 with microprocessor 12 for controlling, for example, the ignition and/or fuel injection of the engine 1. This computer receives from various sensors signals S representing the temperature of the engine cooling water, the temperature of the exhaust gases, the speed and the inlet pressure of the engine, etc. in order to deduce therefrom appropriate commands for the ignition and injection members.

According to the present invention, software and hardware means necessary for controlling the auxiliary 7 are provided in this computer. Of course, these means could be arranged outside of this computer but the presence of the latter in the vehicle makes this solution particularly convenient and economical.

Thus, during a phase in which the engine is started up, this phase being detected via the computer 11, the microprocessor 12, via a power stage 13, commands the modification of the operating conditions of the auxiliary 7 in order to reduce the mechanical power which it absorbs, in order therefore to relieve the engine of the additional load which the auxiliary 7 would otherwise impose on it.

It can be understood that by thus reducing the mechanical power absorbed by several auxiliaries which are not essential to the starting-up of the engine, as is the case with an alternator for charging the battery, with a pump for supplying a power-assisted steering device, or with a compressor of an air-conditioning device, the load on the engine at start-up, and therefore its production of exhaust gases, is substantially reduced, this allowing the antipollution standards mentioned earlier to be complied with despite the current inefficiency of a catalytic converter which may be mounted at the outlet of the exhaust manifold of the engine.

These standards define engine operating cycles for which it is observed that most of the production of harmful species occurs in the very first minutes, after the engine has begun to operate, the engine being started from cold. Relieving the engine during these first minutes is therefore essential for complying with the standards set. The computer also determines the moment when, the engine and/or the catalytic converter 4 having reached a sufficient temperature close to their working temperature, the exhaust gases are sufficiently cleaned of harmful species for activation of the auxiliaries to be authorized so as to enhance the comfort of the vehicle (air-conditioning, power-assisted steering) or to recharge the battery (alternator).

Figure 2:
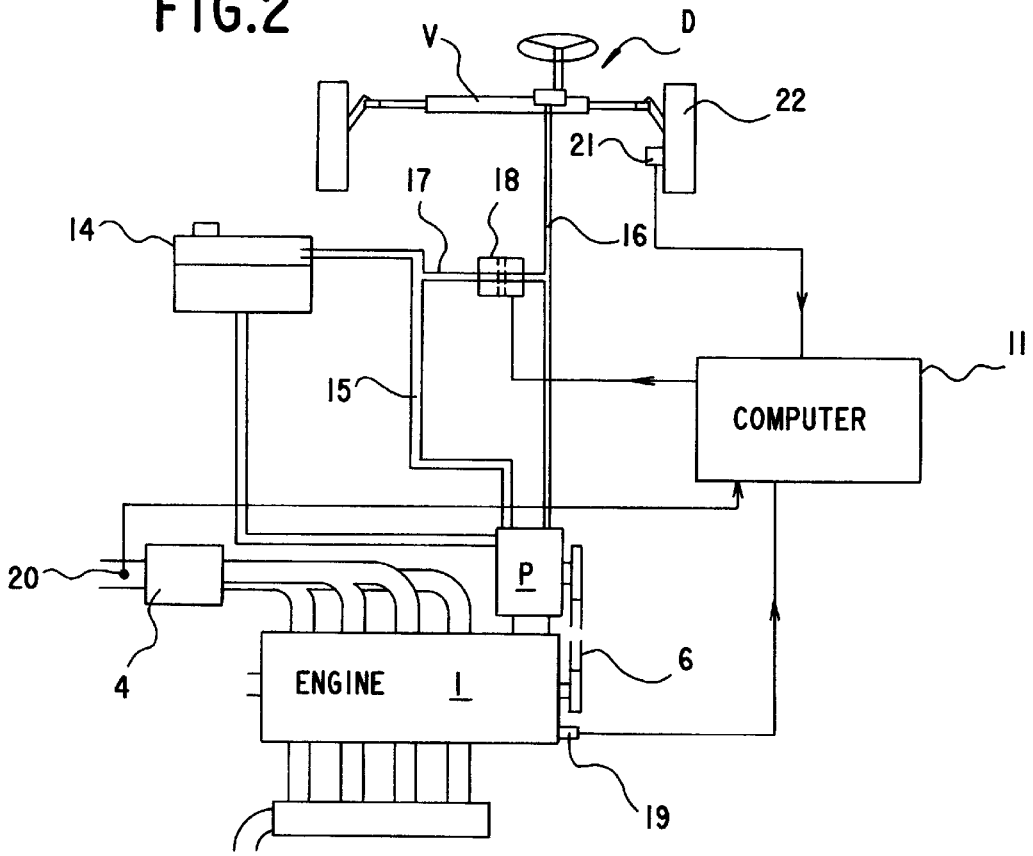
FIG. 2 is a diagram of one embodiment of a device for the implementation of the method according to the invention, applied by way of example to a vehicle equipped with a pump for pressurizing a fluid used in a power-assisted steering mechanism.

FIG. 2 represents another embodiment of the device according to the invention, designed more specifically to reduce or cancel out the load imposed on the output shaft of the engine 1 by a pump P driven by this engine to supply pressurized fluid to a hydraulic cylinder V forming part of a power-assisted steering device D. The pump is supplied by a reservoir 14. A return pipe 15 is placed conventionally between the pump and the reservoir, while the pump delivers into a line 16 for supplying the hydraulic actuator.

According to the present invention, between the line 16 for supplying the hydraulic cylinder V and the pipe 15 there is arranged a bypass pipe 17 on which is mounted a solenoid valve 18 which is normally closed and is controlled by the computer 11. During cold-starting, the computer can thus actuate the solenoid valve 18 in order to open the pipe 17. The outlet from the pump then discharges into the reservoir, preventing the pressure of the fluid supplying the hydraulic cylinder V from rising. The load of the pump on the engine is thus greatly reduced, with a corresponding reduction in the production of exhaust gases.

A solenoid valve with variable pressure drop may be used, which makes it possible to modulate the reduction in load applied to the engine by the pump, according to a control programmed into the computer.

Various strategies for controlling the pump are applicable, at the choice of the designer. By way of example of such a strategy, mention may be made of the one which consists in supplying the hydraulic cylinder with high-pressure fluid only if the temperature of the engine, read by a sensor 19 for sensing the temperature of the coolant, is above a threshold value (60° C. for example) and if the temperature of the exhaust gases read by a temperature sensor 20 placed at the outlet of the catalytic converter 4 is above another threshold value (350° C. for example), or if the vehicle is running, as can be detected using a speed sensor 21 sensitive to the rotation of a wheel 22 of the vehicle.

Figure 3:
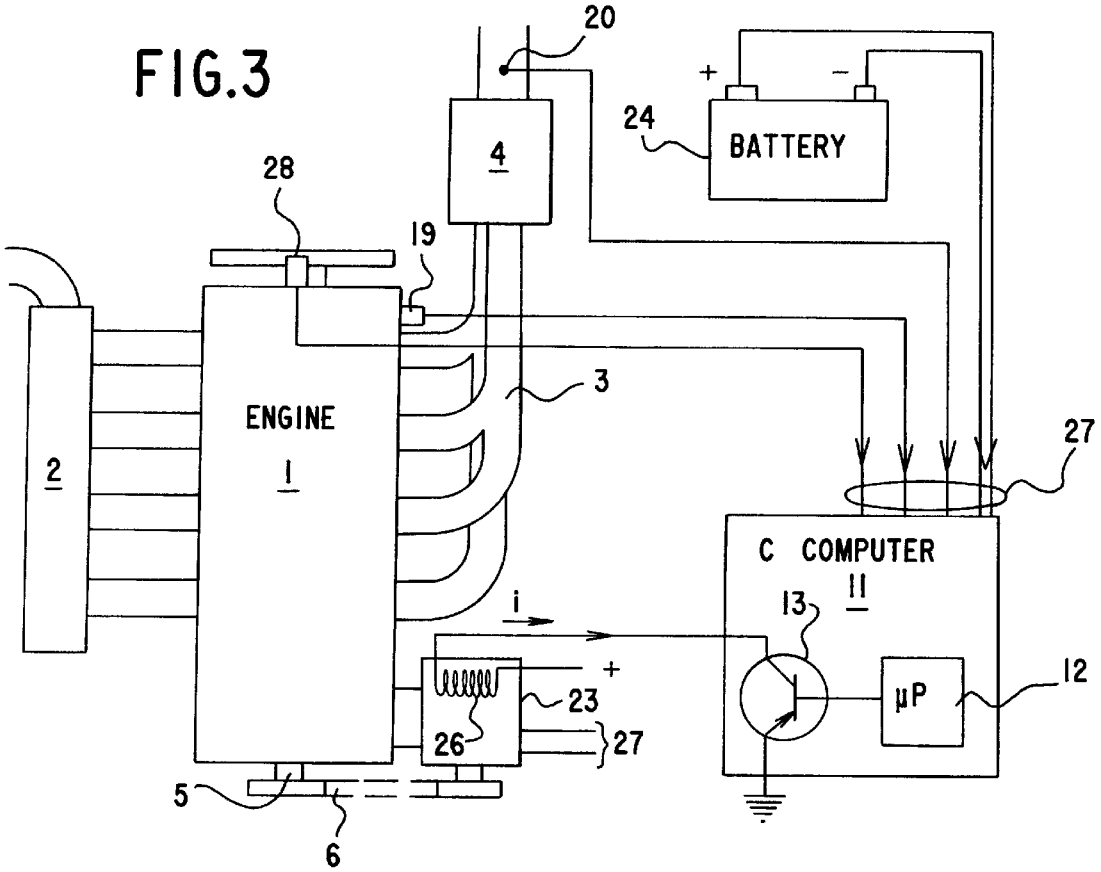
FIG. 3 is a diagram of another embodiment of the device according to the invention, associated with an alternator for recharging the battery of a motor vehicle.

FIG. 3 diagrammatically represents a device according to the invention, designed to relieve the engine of the load which the driving of an alternator 23 conventionally charging the battery 24 of the vehicle via a circuit 25 normally imposes on it, the alternator further comprising one or more excitation windings 26 powered by an excitation current i, as is well known.

According to the present invention, the strength i of this excitation current may be adjusted by the computer 11, the microprocessor 12 of which is duly programmed to control this current, via a power transistor 13 placed in series with the excitation winding 26, between the positive terminal of the battery and ground.

It is known that, conventionally, the engine and the alternator are permanently coupled by a drive belt 6 and that, as a consequence, the engine has to supply a torque to the alternator, including during the start-up phase, this torque being an increasing function of the excitation current i. By reducing or cancelling out this excitation current, according to the invention, during a cold-start phase, this torque is considerably reduced as is the load on the engine which, thus relieved, can start-up by turning over at a lower speed, producing less exhaust gas and therefore less pollution, so that it can meet the standards.

Figure 4:
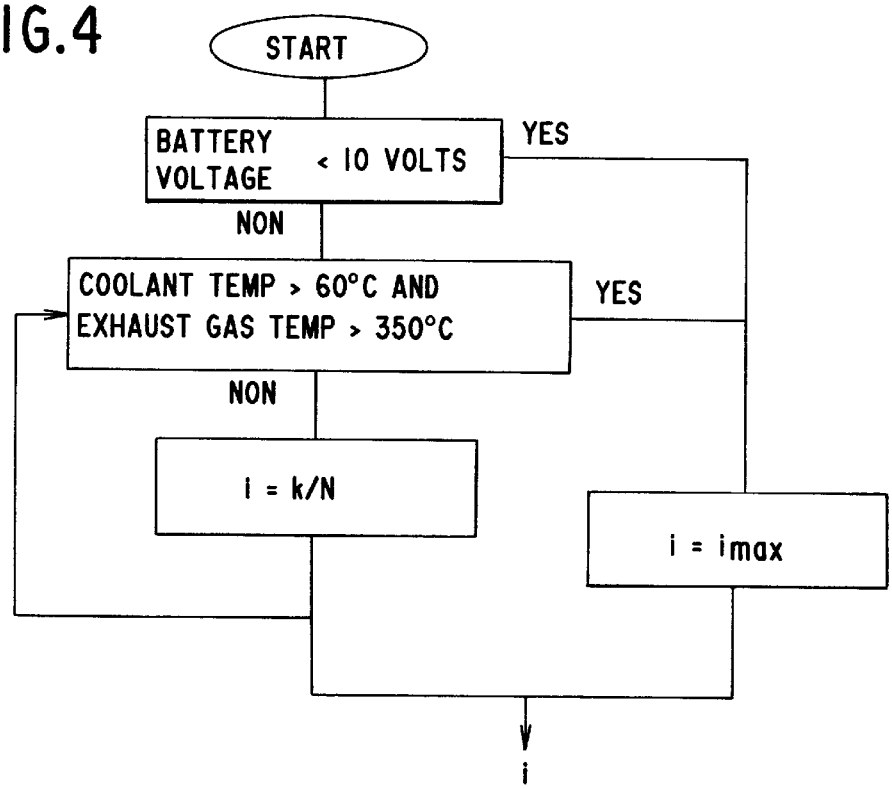
FIG. 4 is a flow chart of a method for implementing the device of FIG. 3.

Various strategies for controlling the excitation current may be programmed into the microprocessor. The flow chart of FIG. 4 illustrates one of these, given purely by way of example. According to this strategy, the output voltage of the battery 24, known by one of the inputs 27 of the computer 11, is compared with a threshold voltage, for example 10 volts, if the nominal voltage of the battery is 12 volts. If the voltage supplied by the battery is below the threshold, the alternator excitation current is set to its maximum value in order to accelerate the charging of the battery and the returning of the output voltage thereof to its nominal value, which is necessary for the vehicle to run well.

In contrast, if, when the vehicle is cold-started as may be detected by the computer by any known means, the output voltage of the battery is above the threshold, the strategy consists in reducing the strength of the alternator excitation current for as long as the engine 1 and the catalytic converter 4 have not reached temperatures close enough to their working temperatures for the amount of harmful species contained in the gases treated by the catalyst to be kept within the limits imposed by the standards to be complied with. Thus, for example, the excitation current will be reduced for as long as the temperature of the coolant, representing that of the engine, is below 60° C. and the temperature of the exhaust gases, representing that of the catalytic converter, is below 350° C.

The excitation current i may therefore be fixed, so as to limit the power absorbed by the alternator while ensuring a minimum charge of the battery, for example to a value given by the formula:

$$i=k/N,$$

where k is a constant and N is the speed of the engine in rpm, measured by a sensor 28, for example a variable-reluctance sensor. Once the temperature thresholds mentioned hereinabove have been reached, the current i is set to its maximum value to ensure appropriate charging of the battery.

Of course the invention is not limited to the embodiments described and represented, which have been given merely by way of example. Thus the invention is not limited to a device for controlling just one of the auxiliaries mentioned hereinabove. A device according to the invention could simultaneously command the total or partial uncoupling of the alternator, of a pump, of a compressor etc. Furthermore, in a vehicle equipped with a mechanism for automatically engaging the engine, the device according to the invention could disengage this clutch in a cold-start phase, so as to relieve the engine of the load that the gearbox imposes on it, even when this gearbox is in neutral.

The present invention affords many advantages. In the start-up phase of the vehicle, it makes it possible to minimize pollution despite the presence of numerous auxiliaries installed to enhance the comfort of the vehicle. The invention may afford a reduction of 10 to 20% approximately in the emissions of unburnt hydrocarbons and of carbon monoxide during a standardized startup cycle. It also makes it possible to model the strategy for controlling the supply of mechanical energy to the auxiliaries, so as to obtain some optimum compromise between controlling the emissions of polluting gases, comfort of the vehicle and recharging of the battery. Incidentally, the controlling of the alternator using the computer furthermore makes it possible to install diagnostic functions for the operation of the means for charging this battery, the dimensions of which may be optimized thanks to the controlled recharging given by the present invention.

We claim:

1. A method for reducing harmful gas emissions of an internal combustion engine propelling a motor vehicle, wherein the internal combustion engine powers at least one auxiliary unit by supplying mechanical energy thereto, the method which comprises:

during a warm-up phase of the internal combustion engine, modifying a given operating condition of an auxiliary unit powered by the internal combustion engine and reducing a mechanical power absorbed by the auxiliary unit as compared with a mechanical power absorbed during a normal operation thereof.

2. The method according to claim 1, which further comprises defining a given engine temperature as an upper limit of the warm-up phase of the internal combustion engine, and terminating the reducing step when the internal combustion engine reaches the given engine temperature.

3. The method according to claim 1, wherein an exhaust gas system of the internal combustion engine includes a catalytic converter, and the method further comprises terminating the reducing step when a temperature of the catalytic converter reaches a predetermined value.

4. The method according to claim 1, wherein the at least one auxiliary unit is an alternator for charging a battery of the motor vehicle, and wherein the modifying step comprises reducing a mechanical power absorbed by the alternator by reducing a strength of an excitation current thereof.

5. The method according to claim 4, which further comprises measuring an output voltage of the motor vehicle battery, and performing the reducing step only if the output voltage of the battery is greater than a predetermined value.

6. A device for reducing harmful gas emissions of an internal combustion engine propelling a motor vehicle, wherein the internal combustion engine powers at least one auxiliary unit by supplying mechanical energy thereto, comprising:

means for defining a warm-up phase of the internal combustion engine;

reducing means for modifying a given operating condition of an auxiliary unit powered by the internal combustion engine during the warm-up phase by reducing a mechanical power absorbed by the auxiliary unit as compared with a mechanical power absorbed during a normal operation thereof.

7. The device according to claim 6, wherein the at least one auxiliary unit of the motor vehicle is a pump for supplying pressurized fluid, and the reducing means include a valve and associated control means for selectively connecting an outlet of the pump to a tank supplying the pump with fluid.

8. The device according to claim 6, wherein the at least one auxiliary unit of the motor vehicle is a compressor, and the reducing means include a valve and associated control means for selectively connecting an outlet of the compressor to a tank supplying the compressor with fluid.

9. The device according to claim 6, wherein the motor vehicle is equipped with a battery and the at least one auxiliary unit is an alternator for charging the battery, and wherein said reducing means comprise means for reducing an excitation current through the alternator during the warm-up phase.

10. The device according to claim 9, further comprising means for measuring an output voltage of the battery, and said reducing means preventing a reduction of the excitation current when the output voltage lies below a predetermined value.

11. The device according to claim 8, wherein the motor vehicle has a computer for controlling at least one of an ignition and an injection in the engine, and said reducing means are incorporated in the computer.

12. The device according to claim 11, wherein the motor vehicle includes a catalytic converter for purifying the exhaust gas of the internal combustion engine and a sensor sensing a temperature of the catalytic converter, the sensor being connected to the computer to the computer, and said reducing means terminating the reduction of the mechanical power absorbed by the auxiliary unit when the temperature of the catalytic converter exceeds a predetermined value.

13. The device according to claim 11, wherein the motor vehicle includes a sensor for sensing a temperature of the internal combustion engine, said reducing means terminating the reduction of the mechanical power absorbed by the auxiliary unit when the temperature of the engine exceeds a predetermined value.

* * * * *

UNITED STATES PATENT AND TRADEMARK OFFICE

CERTIFICATE OF CORRECTION

PATENT NO. : 5,836,151
DATED : November 17, 1998
INVENTOR(S) : Alain Atanasyan et al.

It is certified that error appears in the above-identified patent and that said Letters Patent is hereby corrected as shown below:

Column 7,
Line 1, The device according to claim "8" should read -- Claim 11, line 1,
The device device according to claim "6" --

Drawings,
Fig. 3 should appear as follows:

--

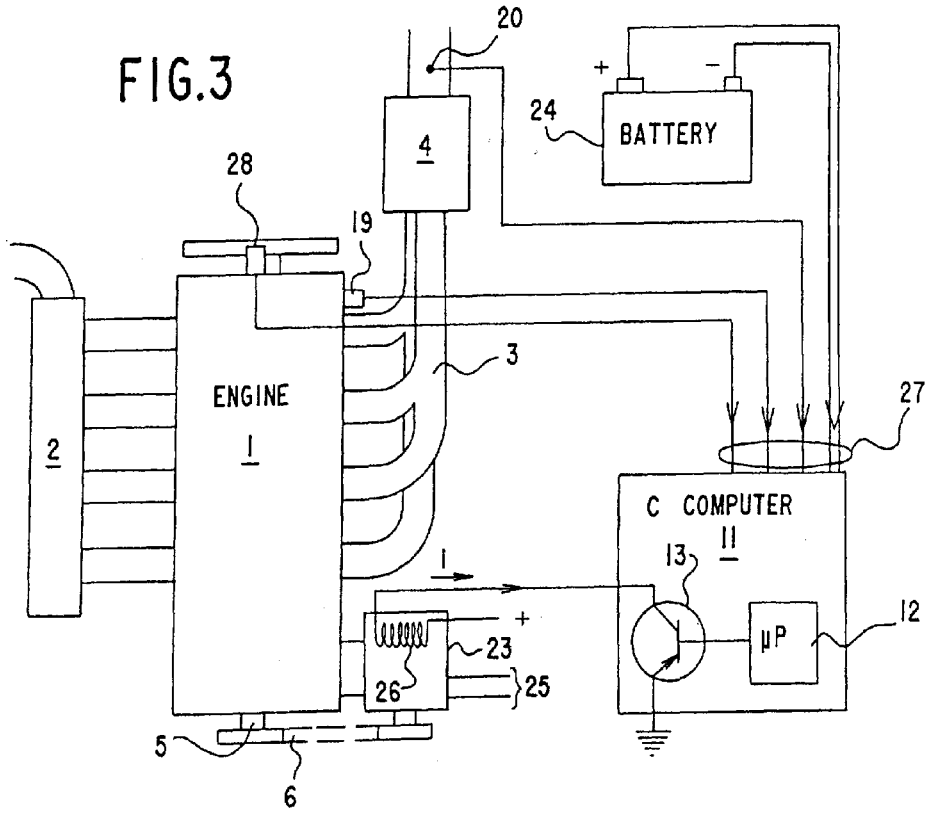

--

UNITED STATES PATENT AND TRADEMARK OFFICE

CERTIFICATE OF CORRECTION

PATENT NO. : 5,836,151
DATED : November 17, 1998
INVENTOR(S) : Alain Atanasyan et al.

It is certified that error appears in the above-identified patent and that said Letters Patent is hereby corrected as shown below:

Fig. 4 should appear as follows:

--

FIG.4

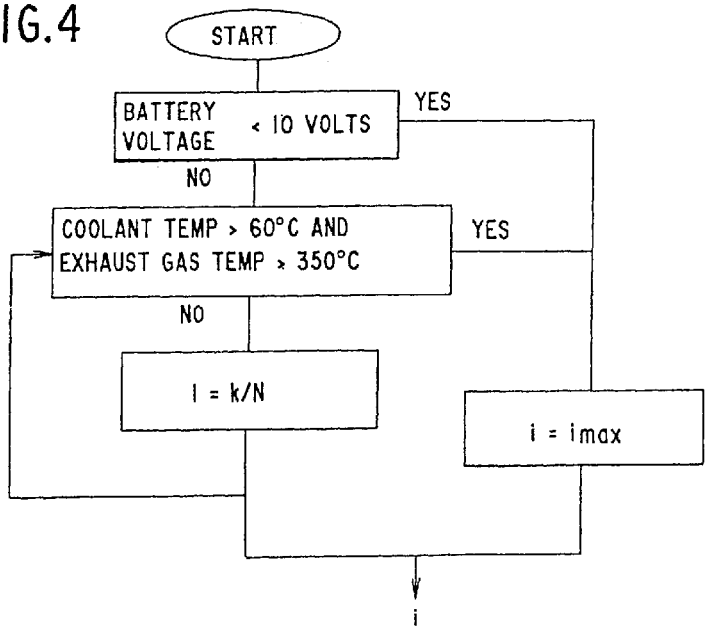

--

Signed and Sealed this

Second Day of July, 2002

*Attest:*

*Attesting Officer*

JAMES E. ROGAN
*Director of the United States Patent and Trademark Office*